United States Patent [19]

Pozzebon

[11] Patent Number: 4,662,089

[45] **Date of Patent: * May 5, 1987**

[54] SKI BOOT, IN PARTICULAR REAR ENTRY SKI BOOT WITH FOOT INSTEP SECURING DEVICE

[75] Inventor: Adolfo Pozzebon, Sala D'Istrana, Italy

[73] Assignee: Nordica S.p.A., Montebelluna, Italy

[ * ] Notice: The portion of the term of this patent subsequent to Apr. 5, 2003 has been disclaimed.

[21] Appl. No.: 580,420

[22] Filed: Feb. 15, 1984

[30] Foreign Application Priority Data

Feb. 24, 1983 [IT] Italy ..... 19745 A/83

[51] Int. Cl.[4] ..... A43B 5/04

[52] U.S. Cl. ..... 36/119; 36/105; 36/50; 24/685 K

[58] Field of Search ..... 36/117–121, 36/50, 89.93, 105, 115; 24/685 K, 695 K, 705 K, 715 K

[56] References Cited

U.S. PATENT DOCUMENTS 4,280,286 7/1981 Sartor ..... 36/118

FOREIGN PATENT DOCUMENTS 2157948 5/1972 Fed. Rep. of Germany ..... 36/50
2712001 9/1977 Fed. Rep. of Germany ..... 36/119
2805943 8/1979 Fed. Rep. of Germany ..... 36/118
596784 3/1978 Switzerland ..... 36/50

*Primary Examiner*—James Kee Chi
*Attorney, Agent, or Firm*—Guido Modiano; Albert Josif

[57] ABSTRACT

This invention is concerned with a ski boot, in particular a rear entry one incorporating a foot instep securing device, which comprises a boot shell having a front leg portion and rear leg portion hingedly connected thereto, and having interiorly a strap associated with one end of said shell and extending over the foot instep. This ski boot comprises a closure element connected to the front leg portion and adapted to perform simultaneously both the fastening of the front leg portion and rear leg portion together, and fastening of the strap onto the foot instep.

11 Claims, 5 Drawing Figures

SKI BOOT, IN PARTICULAR REAR ENTRY SKI BOOT WITH FOOT INSTEP SECURING DEVICE

BACKGROUND OF THE INVENTION

This invention relates to a ski boot, in particular a rear entry ski boot with a foot instep securing device.

As is known, various device types are commercially available for securing the foot in a ski boot. Some of these prior devices, specially conceived for so-called "rear entry" ski boots, generally include a strap, rope, or the like element which extends over the instep region of the foot and is tightened on the instep by actuation of a bulky knob control independent from the closure device of the boot.

That type of closure, while providing a reliable form of instep fastener, has the disadvantage that, because the knob is bulky, the ski boot can prevent only a single closure device for the front and rear leg portions, with consequent difficulty in fastening the ski boot closed.

Other simplified closure types, which are particularly suitable for use with front entry ski boots, also provide in general a lever type of actuator enabling the foot instep to be secured.

None of the current commercial approaches have been able, however, to provide a leg portion closure, especially with rear entry ski boots, easy to carry out, thus resulting in complex actuation procedures which are generally disliked by the user.

SUMMARY OF THE INVENTION

It is a primary object of this invention to obviate such prior drawbacks by providing a foot instep locking or securing device which occupies a reduced space and leaves free the contiguous space optionally for other fixtures or accessory parts of the ski boot.

A further object is to provide such foot instep locking device for rear entry ski boots having a two-point or two-tiered closure of the ski boot, without affecting such closure thus contributing to easier fastening of the leg portion and the required stiffening thereof without involving the inclusion of intervening stiffening metal strips, or other similar arrangements, such as are currently adopted where a single lever is used for the leg portion closure.

Another object of the invention is to provide a foot instep securing device which, while being particularly suitable for use in rear entry ski boots, may also be utilized with other boot types, while allowing the foot to be secured and the boot to be fastened on in a facilitated manner.

It is a further object of this invention to provide a foot instep securing or locking device whose peculiar construction can give full assurance of being reliable and safe to use.

These and other objects, such as will be apparent hereinafter, are all achieved by a ski boot with opposite flap portions and with a foot instep securing device including an actuation strap formation therefor, the ski boot comprising at least one closure device acting on said opposite flap portions for drawing them together, characterized in that said closure device has a base member in engagement simultaneously with said strap formation and with one of said flap portions at least one of said engagements being a limited slidable engagement the other of said engagements being a fixing engagement, a closure mechanism being provided connected with one portion thereof with said base member and with another portion thereof with the other of said flap portions and adapted upon actuation to draw with said another portion thereof said other of said flap portions towards said base member and with said one portion thereof said one of said flap portions and said strap formation towards said other flap portion through said base member.

BRIEF DESCRIPTION OF THE DRAWINGS

Further features and advantages will be more readily understood from the following description of a preferred, though not exclusive, embodiment of this foot instep securing device, in conjunction with the accompanying illustrative drawings, where.

DESCRIPTION OF THE PREFERRED EMBODIMENTS

Figure 1:
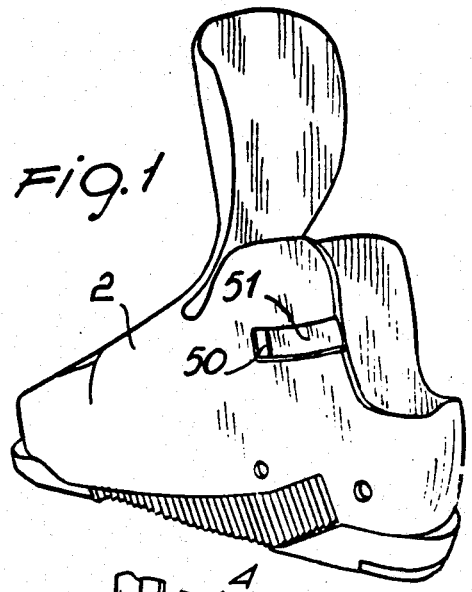
FIG. 1 shows in diagrammatic form one possible embodiment of the shell of this ski boot.

Making reference to the drawing figures, a ski boot, in particular a rear entry ski boot, according to this invention and being generally designated with the reference numeral 1, comprises a shell 2 of a type known per se, which has hingedly connected thereto in a conventional fashion a swingable front leg portion 3 and swingable rear leg portion 4, the shell 2 including an instep region.

Connected inside said shell 2 is one end 5*a* of a strap element 5, which is advantageously affixed at the location of one of the swivel connections bet between the front leg portion 3 and the shell, and extends over the foot instep at an area where a pressure element or pad 6 is advantageously provided which is adapted to improve distribution of the pressure exerted by the strap element to firmly secure the foot.

It should be also mentioned that an inner shoe 10 is also provided as usual inside the ski boot.

According to the invention the strap element 5 is connected, at the other or free or shiftable end thereof, to a closure device which can simultaneously provide tightening of the front leg portion 3 and rear leg portion 4 together, and tightening of said strap 5 onto the foot instep.

In a practical embodiment the front leg portion 3 would be provided, at its rearward region, with a pair of tabs 11 encircling on the rear the boot and the rear leg portion, said tab pair carrying said closure device, generally indicated with the reference numeral 20, and an upper closure device 21, which devices comprise, in the embodiment shown, conventional levers and buckle means but may, at least in principle, comprise any other closure elements capable of bringing together the flaps to be tightened.

The closure devices 20,21 have each a lever arm 25', 25 hinged to a base 30, whereas an end portion of the arm 25', 25, has a tie rod 26', 26 hingedly connected thereto which ends with a toothed portion 27', 27. This toothed portion 27', 27 is engaged by a pawl member 28', 28 fixed to an edge portion of the front leg 3.

Figure 3:
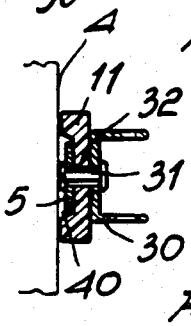
FIG. 3 is a cross-sectional view of the connection between the strap and closure element.

Moreover the base 30 is connected, such as by means of rivets 31, to that end of the strap 5 which is mounted slidably relatively to the tab 11 through the provision of an elongate slot 32 which allows in practice the connection rivets to be passed from the base 30 through the slot 32 to the strap element (see FIG. 3) and at the same time guides the concerned end of the strap 5 and the base 30 along the slot extension.

Figure 4:
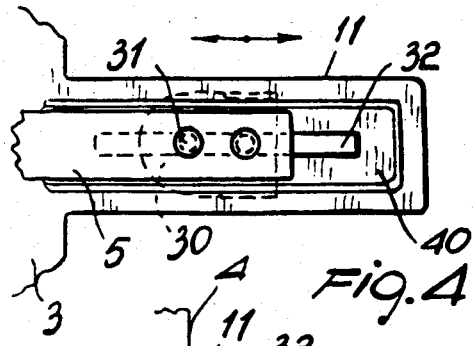
FIG. 4 shows, as viewed from the interior surface, the area of interconnection of the strap and front leg portion.

Advantageously, the tab carrying the closure device 20 which is operative to both close the leg portions and actuate the strap fastening onto the foot instep is formed inwardly with a depression 40 wherein, as visible from FIG. 4, said strap 5 is accommodated slidably and guided as an alternative to or in addition to the guiding action of slot 32.

Furthermore, the cited strap 5 is passed through an opening 50 defined laterally in the shell 2, on the opposite side to the strap end 5*a* (illustrated with dashed line) connected to the shell, the shell 2 being provided also with a recessed portion 51 on its outside surface intended to avoid creating unnecessary protrusions, when the strap is passed through aperture 50.

It should be noted that the tiltable rear leg portion 4 partially overlaps externally the edge portion of the shell 2, where the recess 51 is provided, and the rear upwardly extended edge portion 3*a* of the front leg portion 3, from which the tabs 11 extend externally overlaps partially the tiltable rear leg portion 4, which is thus tiltably and slidably arranged therebetween, the depression 40 provided in the tab 11 being in alignment with the recess 51 but longitudinally offset with respect to it. The front leg portion 3 has an opposite upwardly extending edge portion 11*b* at a distance from edge portion 3*a*.

Thus, with the arrangement described hereinabove, the leg portion of the rear entry ski boot according to this invention can be closed by means of two closure devices, such as of the lever type, to make closing of the leg portion easier, and one of said closure devices—specifically the lowermost closure device—is a multiaction closure device and can also operate, directly while closing the leg portion, the strap 5 to tightly secure the foot instep.

In actual use, therefore, as the closure device 20 is being fastened, the strap element would be simultaneously fastened onto the foot instep, and conversely, as the closure device is being released, the strap is also released, which effect is enhanced by the fact that the base 30 of the lever element forming the closure element is enabled to slide relatively to the leg portion owing to the presence of the slot 32, thus allowing the foot fastening strap to be relaxed even further.

Figure 5:
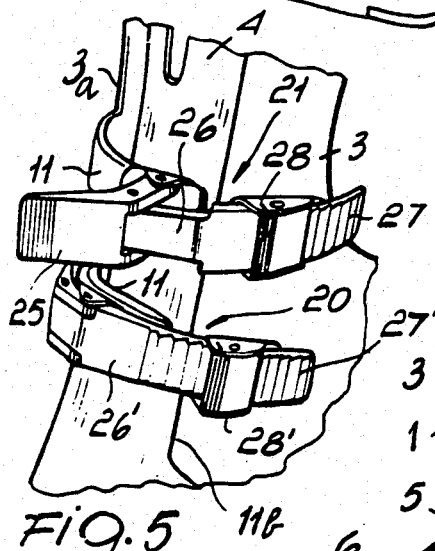
FIG. 5 is a detail view of the closure elements, seen from the opposite side with respect to FIG. 2.
Figure 2:
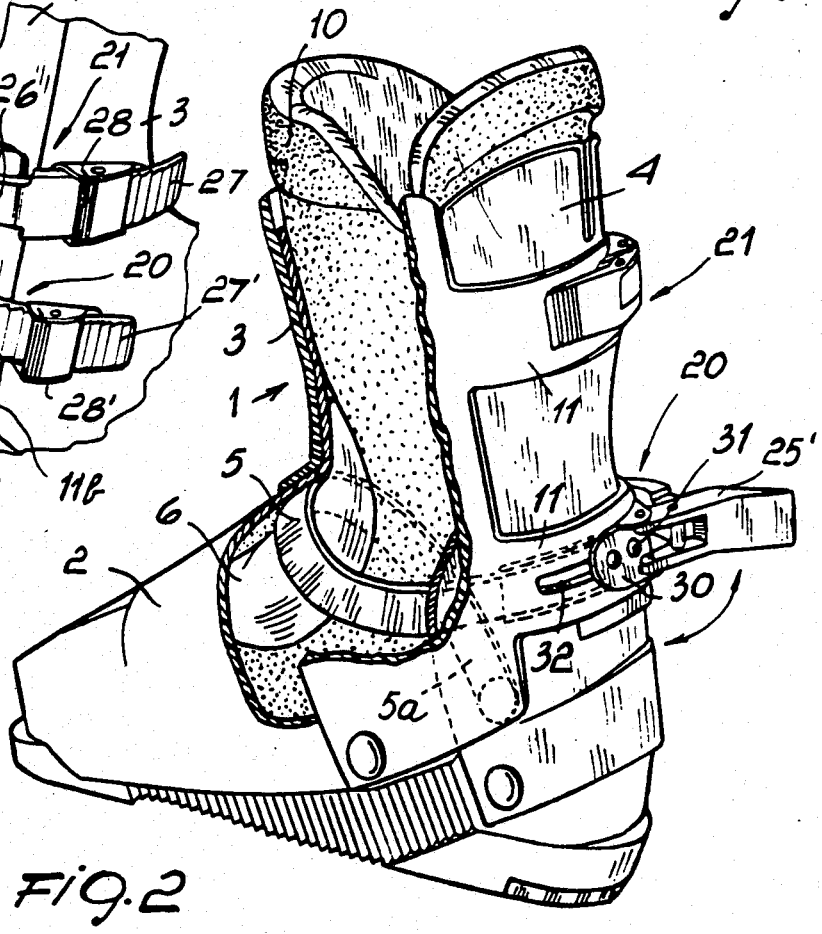
FIG. 2 illustrates the securing device, as applied to a ski boot, shown in a partly cut-away view.

In operation, it will be noted that when the base 30 is moved towards the right in FIGS. 2, 4, by the closing action of lever 25 first the strap 5 is entrained towards the right, while the lower tab 11 is only urged towards the right by the friction action exerted thereon by the base 30 sliding thereover, whereas the tie rod 26' urges the pawl member 28' to the left in FIG. 5 with a force, which is the sum of the opposite forces acting on the strap 5 and the friction force acting on the lower tab 11 thereby a full closing action is exerted towards the left in FIG. 5 by the pawl member 28' on the edge portion 11*b* of the front leg portion 3 of the ski boot and a full fastening action is also exerted on the strap 5, in FIG. 4, while a partial closing action is exerted on the tab 11 of the front leg portion 3 in FIGS. 2 and 4. Even though a thus distributed closing action may be sufficient in certain conditions, if required the tab 11 may be further tightened when the base 30 reaches the right hand end of the slot 32 in FIG. 4 thereby fully dragging therewith the tab 11 towards the right, if necessary.

It should be also pointed out that, where desired, adjuster means may be provided for changing the fastening position between said base and strap, thereby the strap 5 may be tightened adjustably.

It will be appreciated from the foregoing description that the invention achieves its objects, and in particular that the provision of a single device acting as a leg portion fastening closure and as foot instep securing element results in rear entry ski boots equipped with an adjustable instep securing device, which have two leg portion closure devices, thereby deformation of the leg portion is effectively prevented while skiing without resorting to the conventional reinforcements and without encountering any problems with the closure of the leg portion.

A further important aspect of the invention is that the closing or tightening operation of the multi-action closure device is made quite simple, since a single actuation movement can secure both the foot instep and the leg portion in its closed condition.

The invention as discussed is susceptible to many modifications and variations, without departing from the true scope of the inventive idea.

All of the details, moreover, may be replaced with other technically equivalent elements.

In practicing the invention, the materials used, contingent on the application contemplated, and the shapes and dimensions, may be any selected ones to meet individual requirements.

I claim:

1. A ski boot, in particular a rear entrance ski boot with a foot instep securing device comprising; a boot shell defining a foot instep region, a front leg portion and a rear leg portion hingedly connected to said shell, a pressure element adapted to be movably accommodated at said instep region of said shell, at least one strap element having at least one fixed end and at least one shiftable end, closure means including at least one actuation element, and at least one shiftable base element, said fixed end of said strap element being fixedly associated with said shell, said at least one strap element, extending substantially upwardly from said fixed end thereof to said pressure element, said at least one strap element further extending from said pressure element to said shiftable end thereof, said shiftable end of said strap element being rigidly fastened to said shiftable base element, said shiftable base element being associated with said closure means, said closure means being adapted for closing together said front leg portion and said rear beg portion, said actuation element being adapted for actuating said closure means and simutaneously effecting movement of said shiftable base element and said shiftable end of said strap element, said movement of said shiftable end causing actuation movement of said pressure element.

2. A ski boot according to claim 1 wherein said fixed end of said strap element is connected to said boot shell at an area of hinge connection between said front leg portion and said shell, on the interior thereof, and wherein said shell defines, on an opposite side to the connection of the fixed end to the boot shell, an opening, and a recess, said strap element extending from said fixed end, over said pressure element and being passed out of said shell through said openings.

3. A ski boot according to claim 2 wherein said recess is adapted for guiding movement of said strap element in a direction extending from said opening to said closure means.

4. A ski boot according to claim 1, wherein said front leg portion comprises at least one tab, said tab extending rearwardly from said front leg portion and being adapted to encircle said rear leg portion, said tab having as elongate slot formed therein.

5. A ski boot according to claim 1, wherein said shiftable base element associated with said closure means is rigidly connected to said shiftable end of said strap element and slidable relatively to said elongate slot, said elongate slot being adapted for guiding said movement of said base element, and said shiftable end of said strap element attached thereto for causing actuation movement of said pressure element.

6. A ski boot according to claim 5 wherein said closure means comprises a lever arm, said lever arm being hingedly connected to said base, said closure means further comprising a pawl member and a tie rod, having at one end thereof an end portion and at another end thereof a toothed portion, said pawl member being rigidly associated with said front leg portion and adapted to releasably engage said toothed portion of said lever arm, said end portion of said tie rod being hingedly connected to said lever arm, said base element being adapted for guided sliding movement along said elongate slot upon operation of said lever arm in a direction extending towards said pawl member upon said lever arm being actuated in a direction leading away from said pawl member.

7. A ski boot according to claim 1, wherein said front leg portion defines at least one tab, said tab being adapted to encircle said rear leg portion and having formed therein an elongate slot, wherethrough said free end of said strap element communicates in fixed engagement relationship with said base element, said tab being further provided with a recess, said recess being adapted for accommodating and guiding said shiftable end of said strap element.

8. A ski boot according to claim 1 including flap portions adapted to be closed together and having at least one closure device comprising a ratchet pawl member, a tie rod having a toothed portion provided at least at an end thereof and an end portion defined at an other end thereof, a lever arm and a base, said ratchet pawl member being rigidly associated with one of said flap portions to be closed together and adapted to releasably engage said toothed portion of said tie rod, said end portiond thereof being hingedly connected to said lever arm said lever arm having an end, said end of said lever arm being hingedly connected to said base, said base being slideably mounted on said other of said flap portions to be closed together, said lever arm being at least actuable for slideably moving said base along a direction extending towards said ratchet pawl on said other of said flap portions to be closed together.

9. A ski boot according to claim 1, wherein said closure means is located at an area substantially corresponding to a lower rear leg portion of said ski boot.

10. A rear entrance ski boot having a longitudinal extension and an upwards extension transverse to said longitudinal extension, said ski boot including a shell portion defining a foot instep region, a swingable front leg portion hinged on said shell portion and a swingable rear leg portion hinged on said shell portion, said swingable front leg portion having at one side thereof a first upwardly extending edge partially overlapping said swingable rear leg portion and on the other side thereof an opposite upwardly extending edge at a distance from said first upwardly extending edge, said swingable front leg portion having at least one tab extending from said first upwardly extending edge in a direction transverse thereto and over said swingable rear leg portion towards said opposite upwardly extending edge, a pressure element in said instep region within said shell portion, a strap member extending over said pressure element and having one end thereof fixed on said shell portion and on opposite shiftable end in the reach of said tab, a closure mechanism comprising on one end thereof a base element slidable along said tab and in frictional relationship therewith, said base element being rigidly connected with said shiftable end, said closure mechanism having on the other end thereof lever and buckle means connected to said other side of said front leg portion near said opposite upwardly extending edge thereof thereby to pull in closed condition of said closure mechanism, through said base element, said shiftable end of said strap member, said tab and said opposite upwardly extending edge simultaneously towards each other and thereby simultaneously exerting, through said thereby tensioned strap element, a pressing action onto said pressure element, the opposite occurring in opened condition of said closure member.

11. A rear entrance ski boot having a longitudinal extension and an upwards extension transverse to said longitudinal extension, said ski boot including a shell portion defining a foot instep region, a swingable front leg portion hinged on said shell portion and a swingable rear leg portion hinged on said shell portion, said swingable front leg portion having at one side thereof a first upwardly extending edge partially overlapping said swingable rear leg portion and on the other side thereof an opposite upwardly extending edge at a distance from said first upwardly extending edge, said swingable front leg portion having at least one tab extending from said first upwardly extending edge in a direction transverse thereto and over said swingable rear leg portion towards said opposite upwardly extending edge, a pressure element in said instep region within said shell portion, a strap member extending over said pressure element and having one end thereof fixed on said shell portion and an opposite shiftable end in the reach of said tab, said tab having a slot extending in said direction of said tab, a closure mechanism which comprises a base element over said slot and slidable along said tab and in frictional relationship with said tab, rivet means fixed on said base element and extending through said slot to guide said base element while the base element is slided along said tab, said rivet means being connected to said shiftable end of said strap member thereby providing connection between said shiftable end of said strap member and said base element, the closure mechanism further comprising a lever hinged on said base element, a tie rod element hinged on said lever and having a toothed portion at a free end thereof, a pawl member fixed on said front leg portion near said opposite upwardly extending edge and adjustably engageable with said toothed portion, thereby in closed condition of said closure mechanism said base element simultaneously pulling said shiftable end of said strap member and said tab towards said opposite upwardly extending edge portion and thereby tightening said strap member to exert a pressing action onto said pressure element, and in opened condition of said closure mechanism said base element being shifted towards said first upwardly extending edge portion thereby to push said tab away from said opposite upwardly extending edge portion and slacken said strap member to remove a pressing action on said pressure member.

* * * * *